US007013488B2

(12) United States Patent
Lewis et al.

(10) Patent No.: US 7,013,488 B2
(45) Date of Patent: Mar. 21, 2006

(54) SURGICAL GOWN WITH A PANEL SECTION OF ELASTOMERIC BARRIER MATERIAL

(75) Inventors: Andrea L. Lewis, Alpharetta, GA (US); Julia T. Ambrose, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 46 days.

(21) Appl. No.: 10/732,170

(22) Filed: Dec. 10, 2003

(65) Prior Publication Data

US 2005/0125871 A1 Jun. 16, 2005

(51) Int. Cl.
*A41D 13/00* (2006.01)

(52) U.S. Cl. ..... 2/51; 2/69; 2/79; 2/114

(58) Field of Classification Search ..... 2/69, 2/113–115, 455, 901, 83, 85, 81, 93–95, 82, 2/243.1, 102–108, 79, 80, 105–106, 74, 75, 2/78.1–78.3, 900, 902, 48, 49, 50, 51, 52
See application file for complete search history.

(56) References Cited

U.S. PATENT DOCUMENTS

| | | | | |
|---|---|---|---|---|
| 3,086,214 A | | 4/1963 | Lash | |
| 3,654,632 A | | 4/1972 | Lacroix | |
| 3,720,957 A | * | 3/1973 | Patience | 2/114 |
| 3,868,728 A | | 3/1975 | Krzewsinski | |
| 4,525,407 A | | 6/1985 | Ness | |
| 4,670,913 A | | 6/1987 | Morell et al. | |
| 4,698,849 A | | 10/1987 | Mitchell et al. | |
| 5,097,534 A | | 3/1992 | Viemeister et al. | |
| 5,461,724 A | | 10/1995 | Wiedner et al. | |
| 5,492,753 A | | 2/1996 | Levy et al. | |
| 5,582,903 A | | 12/1996 | Levy et al. | |
| 5,680,653 A | * | 10/1997 | Mathis et al. | 21/23 |
| 5,695,849 A | | 12/1997 | Shawver et al. | |
| 5,724,674 A | | 3/1998 | Covington et al. | |
| 5,794,276 A | | 8/1998 | Walker | |
| 5,883,028 A | | 3/1999 | Morman et al. | |
| 6,028,240 A | | 2/2000 | Wessel et al. | |
| 6,052,826 A | | 4/2000 | Tolton | |
| 6,115,839 A | | 9/2000 | Covington et al. | |
| 6,671,884 B1 | | 1/2004 | Griesbach, III et al. | |
| 6,799,331 B1 | * | 10/2004 | Griesbach et al. | 2/69 |
| 2002/0138893 A1 | | 10/2002 | Culhane | |
| 2003/0028950 A1 | | 2/2003 | Walsh | |
| 2003/0221237 A1 | | 12/2003 | Griesbach, III et al. | |

FOREIGN PATENT DOCUMENTS

| | | |
|---|---|---|
| EP | 0602613 A1 | 6/1994 |
| EP | 1163858 | 12/2001 |
| WO | 0103528 | 1/2001 |

OTHER PUBLICATIONS

U.S. Appl. No. 10/286,388, filed Nov. 1, 2002.

* cited by examiner

*Primary Examiner*—Gloria M. Hale
(74) *Attorney, Agent, or Firm*—Dority & Manning

(57) ABSTRACT

A protective garment, such as a surgical gown, includes a body having a closed front, an open back, and sleeves. The closed front extends below a wearer's knees when the garment is donned. The closed front incorporates a section of elastomeric material that extends generally from an upper chest region of the garment to a location above a bottom edge of the gown that is also below the wearer's knees when the garment is donned. A border region of non-elastomeric material extends generally transversely across the closed front between the bottom edge of the garment and a bottom of the elastomeric material.

14 Claims, 3 Drawing Sheets

SURGICAL GOWN WITH A PANEL SECTION OF ELASTOMERIC BARRIER MATERIAL

TECHNICAL FIELD OF THE INVENTION

The present invention relates generally to the field of protective garments, and more particularly to an improved surgical gown configuration.

BACKGROUND

Protective garments such as surgical gowns are well known. The usefulness of these garments is generally influenced by a number of factors, such as breathability, resistance to fluid flow, barrier protection qualities, etc. Comfort of the garment is also an important factor. For example, a surgical gown must be comfortable to a person wearing the garment for extended hours. Factors affecting the comfort of the garment include the stretch properties, softness, and breathability of the garment material. Materials that are soft, stretchable, and breathable are typically more comfortable than materials that do not have those characteristics.

Conventional disposable surgical gowns are commonly constructed from a nonwoven fabric. The gown body section is generally a singular piece of material, or is composed of a number of panels of material attached together, for example, a front panel and attached side panels that also define a back section of the gown. Sleeves are attached to the gown body by any number of known techniques. An example of a surgical gown made using raglan-type sleeves attached to a one piece gown body is the Lightweight Gown (product code 90751) from Kimberly-Clark, Corp. of Neenah, Wis., USA.

A drawback to the conventional gown design is that the gowns tend to be unduly restrictive in the chest and torso regions, particularly for larger wearers. To accommodate various sized users, the gowns are offered in different sizes (e.g., "medium", "large", "extra-large", and so forth). However, even with such size variations, many users cannot be adequately accommodated. For example, a user of shorter and broader stature cannot reasonably wear an "extra-large" gown, but may also find the smaller sized gowns to be uncomfortable, particularly in the chest and torso regions.

Also, although the known neck and waist fastening systems of conventional gowns have some degree of adjustability, many users find the gowns to be restrictive in these regions as well.

An additional drawback to conventional gown configurations is that the gowns tend to restrict the user's ability to sit comfortably. The gowns tend to wrap relatively tightly around the legs of the wearer in the seated position and prevent movement of the knees. Because of the restrictive forces, the gowns also tend to ride up on the wearer in the seated position to relieve the tension in the material, thereby exposing the wearer's legs and compromising the sterile field, as well as exposing the clinician to potential contaminants.

A common method to attempt to reduce (relieve) restrictive forces is to incorporate more fabric in the areas placed under tension, such as via pleats, or inserted secondary patches. Another approach suggested in the art is to construct the gown body in its entirety, or entire panel sections, out of an elastomeric or recoverable-stretch material so that when the fabric is subjected to the restrictive forces (the forces encountered by a non-elastomeric fabric), the fabric elongates. Various elastomeric nonwoven materials and fabrics are available for such purpose, including laminates of a nonwoven web and elastomeric film.

A drawback of making the entire gown body, or entire panel portions, of an elastomeric material is that such materials are significantly more costly, and thus add to the overall cost of the product and healthcare in general. Also, depending on the amount and placement of the elastomeric materials, the sterile field may still be compromised by movement of the gown on the wearer.

The present invention relates to a unique configuration for a protective garment, particularly a surgical gown, that has the benefits of elastomeric materials to address certain drawbacks with conventional gowns without sacrificing the gowns protective nature or compromising the sterile field.

SUMMARY

Objects and advantages of the invention will be set forth in part in the following description, or may be obvious from the description, or may be learned through practice of the invention.

The present invention relates to a unique configuration for a protective garment, particularly a surgical gown, wherein a body portion of the garment has a closed front, an open back, and sleeves. The closed front defines a neckline and a bottom edge that extends below a wearer's knees when the garment is donned. The closed front also incorporates a section of elastomeric material that extends generally from an upper chest region of the garment to a location above the bottom edge of the gown such that the elastomeric material also extends below the wearer's knees when the garment is donned. A border region, such as a transversely extending strip, of non-elastomeric material extends generally transversely across the closed front between the bottom edge of the garment and a bottom of the elastomeric material. This border region of non-elastomeric material may define the bottom edge of the gown.

The unique configuration of the garment provides significant benefits to the wearer. The elastomeric material section across the chest region provides relief in an area often identified by wearers as being most restrictive. Because the elastomeric material section also extends below the knees, the wearer can easily spread their knees in a seated position and is thus provided with significantly increased flexibility and comfort. The border region of non-elastomeric material that extends transversely between the bottom of the elastomeric material and the bottom edge of the gown does not readily stretch or expand and, thus, functions as a cuff around the bottom portion of the wearer's legs (i.e., below the knees). This cuff inhibits the garment from riding up on the wearer when seated, and thus preserves the sterile field while protecting the wearer's legs.

The elastomeric material section is not limited to any particular shape. In one particular embodiment, the section extends from a neckline of the closed front to generally below a knee section of the garment. The elastomeric material may define the neckline and extend to side seams of the gown (including sleeve seams) so as to define a substantial portion of the closed front.

In a particular embodiment, the gown is assembled from separately formed back portions or panels that are attached along longitudinal seams to a front panel, the back portion panels and front panel defining sleeve openings to which are attached separately formed sleeves. The front panel may be defined substantially of elastomeric material with a bottom border of non-elastomeric material that also defines the bottom edge of the closed front.

In still an alternate embodiment, the gown body may be defined by a single integral panel of generally non-elastomeric material wherein the elastomeric material section is provided as a bib-type insert that is fitted to an opening in the front section of the garment. For example, the bib may be fitted into a closed opening that is cut into the integral panel such that the bib is completely surrounded by non-elastomeric material. In an alternate embodiment, the bib may define the upper neckline edge of the gown.

It should be thus appreciated that the style and configuration of the garments is not a limiting factor. Regardless of the type of garment, the elastomeric material section is provide in the closed front of the garment to relieve material tension and stress in the chest region, and to provide the wearer with the ability to comfortably sit and spread their knees, with the lower border region of less-elastomeric or completely non-elastomeric material inhibiting the garment from riding up over the wearer's knees.

It should also be appreciated that a garment, in particular a surgical gown, constructed in accordance with the invention is not limited to any particular type of materials. Conventional materials for forming the body and sleeves of a gown are well known to those skilled in the art, and any such material may be used for a gown in accordance with the present invention. Likewise, there are a number of elastomeric extensible materials used in the art that may serve adequately as the elastomeric material section for use in the present invention. Examples of such materials will be described in greater detail below.

The invention will be described in greater detail below by reference to embodiments illustrated in the figures.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION

Figure 1:
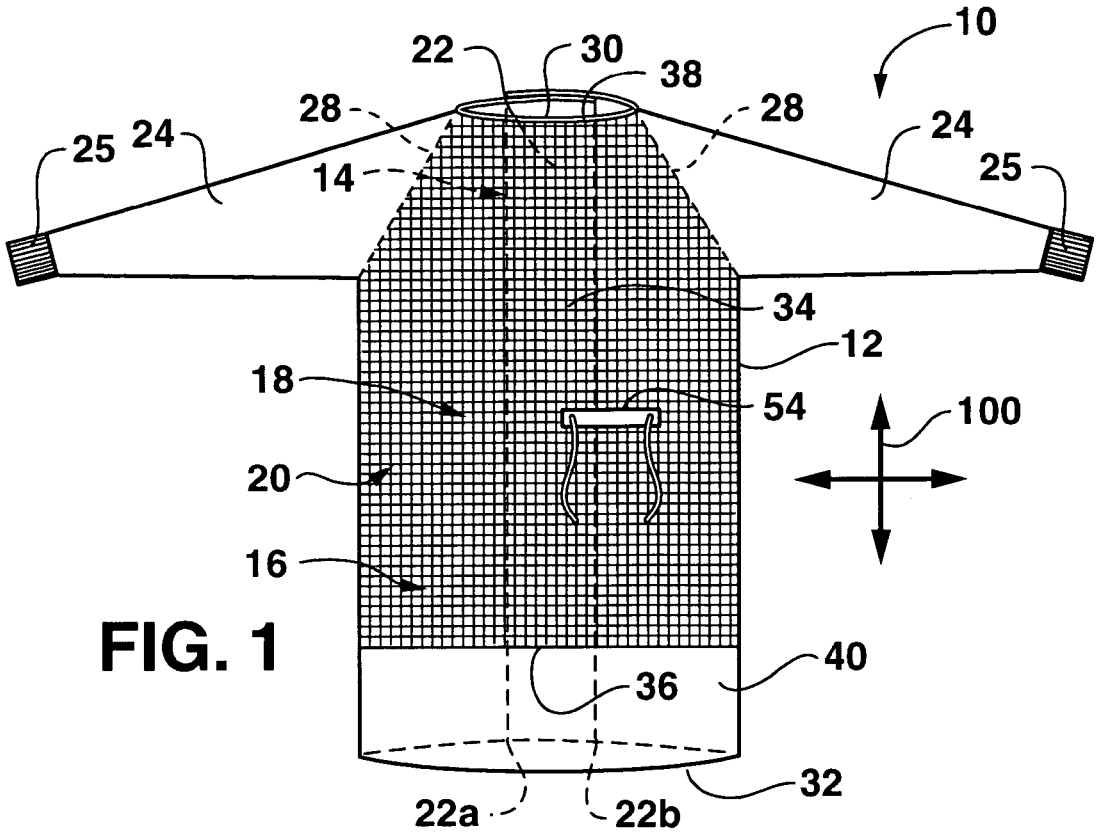
FIG. 1 is a front view of an embodiment of a protective garment in accordance with the invention.

Reference will now be made in detail to one or more embodiments of the invention, examples of which are graphically illustrated in the drawings. Each example and embodiment are provided by way of explanation of the invention, and not meant as a limitation of the invention. For example, features illustrated or described as part of one embodiment may be utilized with another embodiment to yield still a further embodiment. It is intended that the present invention include these and other modifications and variations.

"Attached" refers to the bonding, joining, adhering, connecting, attaching, or the like, of two elements. Two elements may be considered attached together when they are bonded directly to one another or indirectly to one another, such as when each is directly attached to an intermediate element.

"Elastomeric" refers to a material or composite which can be extended or elongated by at least 25% of its relaxed length and which will recover, upon release of the applied force, at least 10% of its elongation. It is generally preferred that the elastomeric material or composite be capable of being elongated by at least 100%, and recover at least 50% of its elongation. An elastomeric material is thus stretchable and "stretchable", "elastomeric", and "extensible" may be used interchangeably.

"Elastic" or "Elasticized" means that property of a material or composite by virtue of which it tends to recover towards its original size and shape after removal of a force causing a deformation.

"Neck-bonded" laminate refers to a composite material having an elastic member that is bonded to a non-elastic member while the non-elastomeric member is extended in the machine direction creating a necked material that is elastic in the transverse or cross-direction. Examples of neck-bonded laminates are disclosed in U.S. Pat. Nos. 4,965,122; 4,981,747; 5,226,992; and 5,336,545, which are incorporated herein by reference in their entirety for all purposes.

"Stretch-bonded" laminate refers to a composite material having at least two layers in which one layer is a gatherable layer and the other layer is an elastic layer. The layers are joined together when the elastic layer is in an extended condition so that upon relaxing the layers, the gatherable layer is gathered. For example, one elastic member can be bonded to another member while the elastic member is extended at least about 25% of its relaxed length. Such a multi-layer composite elastic material may be stretched until the non-elastic layer is fully extended. Examples of stretch-bonded laminates are disclosed, for example, in U.S. Pat. Nos. 4,720,415, 4,789,699, 4,781,966, 4,657,802, and 4,655,760, which are incorporated herein by reference in their entirety for all purposes.

As used herein, the term "nonwoven web" refers to a web that has a structure of individual fibers or filaments which are interlaid, but not in an identifiable repeating manner. Nonwoven webs have been, in the past, formed by a variety of processes known to those skilled in the art such as, for example, meltblowing and melt spinning processes, spunbonding processes and bonded carded web processes.

As used herein, the term "spunbonded web" refers to web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown web" refers to a nonwoven web formed by extruding a molten thermoplastic material through a plurality of fine, usually circular, die capillaries as molten fibers into converging high velocity gas (e.g. air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin, et al., which is incorporated herein in its entirety by reference thereto for all purposes. Generally speaking, meltblown fibers may be microfibers that may be continuous or discontinuous, are generally smaller than 10 microns in diameter, and are generally tacky when deposited onto a collecting surface.

As used herein, the term "disposable" is not limited to single use or limited use articles but also refers to articles that are so inexpensive to the consumer that they can be discarded if they become soiled or otherwise unusable after only one or a few uses.

As used herein, the term "garment" refers to protective garments and/or shields including for example, but not limited to, surgical gowns, patient drapes, work suits, aprons and the like.

As used herein, the term "liquid resistant" or "liquid repellant" refers to material having a hydrostatic head of at least about 25 centimeters as determined in accordance with the standard hydrostatic pressure test AATCCTM No. 127-1977 with the following exceptions: (1) The samples are larger than usual and are mounted in a stretching frame that clamps onto the cross-machine direction ends of the sample, such that the samples may be tested under a variety of stretch conditions (e.g., 10%, 20%, 30%, 40% stretch); and (2) The samples are supported underneath by a wire mesh to prevent the sample from sagging under the weight of the column of water.

As used herein, the term "breathable" means pervious to water vapor and gases. For instance, "breathable barriers" and "breathable films" allow water vapor to pass therethrough, but are liquid resistant. The "breathability" of a material is measured in terms of water vapor transmission rate (WVTR), with higher values representing a more breathable material and lower values representing a less breathable material. Breathable materials generally have a WVTR of greater than about 250 grams per square meter per 24 hours ($g/m^2/24$ hours). In some embodiments, the WVTR may be greater than about 1000 $g/m^2/24$ hours. Further, in some embodiments, the WVTR may be greater than about 3000 $g/m^2/24$ hours. In some embodiments, the WVTR may be greater than about 5000 $g/m^2/24$ hours.

As used herein, the term "reversibly-necked material" refers to a necked material that has been treated while necked to impart memory to the material so that when force is applied to extend the material to its pre-necked dimensions, the necked and treated portions will generally recover to their necked dimensions upon termination of the force. A reversibly-necked material may include more than one layer. For example, multiple layers of spunbonded web, multiple layers of meltblown web, multiple layers of bonded carded web or any other suitable combination of mixtures thereof. The production of reversibly-necked materials is illustrated in patents such as, for example, Mormon, U.S. Pat. Nos. 4,965,122 and 4,981,747.

The present invention relates to a unique configuration for a protective garment. The garment is illustrated and described herein as a disposable surgical gown for illustrative purposes. It should be appreciated though that a garment in accordance with the invention is not limited to a gown, and may include, for example, a patient gown or drape, work coverall, robe, etc.

A conventional gown 10 is conceptually illustrated in FIG. 1. The gown includes a gown body 12 made from a generally non-elastomeric material and having a closed front 20 and an open back 22. The back is "open" in that open sides 22*a* and 22*b* provide access to the gown 12 and are secured at the wearer's back. The gown body 12 may be formed from a single piece of material, or may be defined by separate panels of material joined at seams, as described in greater detail below.

Figure 2:
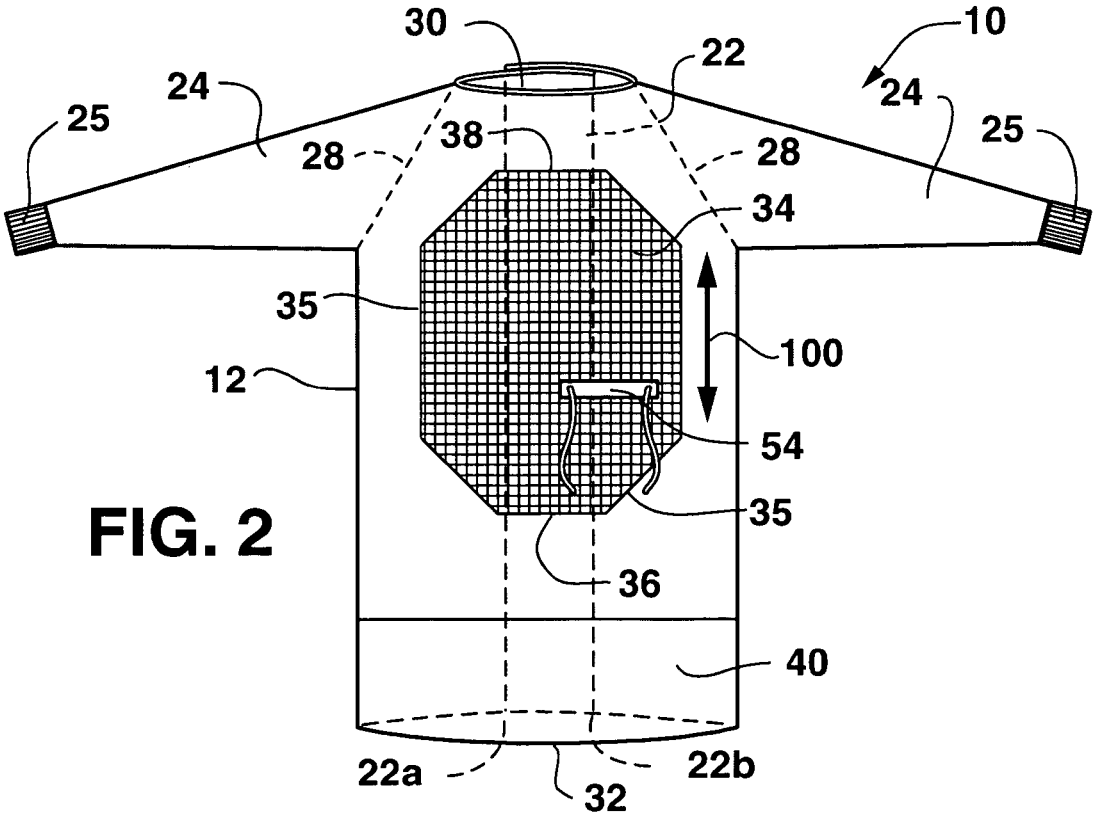
FIG. 2 is a front view of an alternate embodiment of a garment in accordance with the invention.

Sleeves 24 are generally attached to the gown body 12 at sleeve openings 26 (FIG. 2) defined in the body 12. The sleeves 24 may be of the same or a different material as the body 12 and may be attached to the body 12 at sleeve seams 28. Elastomeric cuffs 25 may be provided at the ends of the sleeves 24. Any conventional securing mechanism, such as strap or tie 54, may be provided with the closed front 20 and/or open back 22 for securing the gown 10 once donned.

It should be appreciated that various configurations of gowns 10 are well known to those skilled in the art and all such configurations are within the scope and spirit of the invention.

Figure 6:
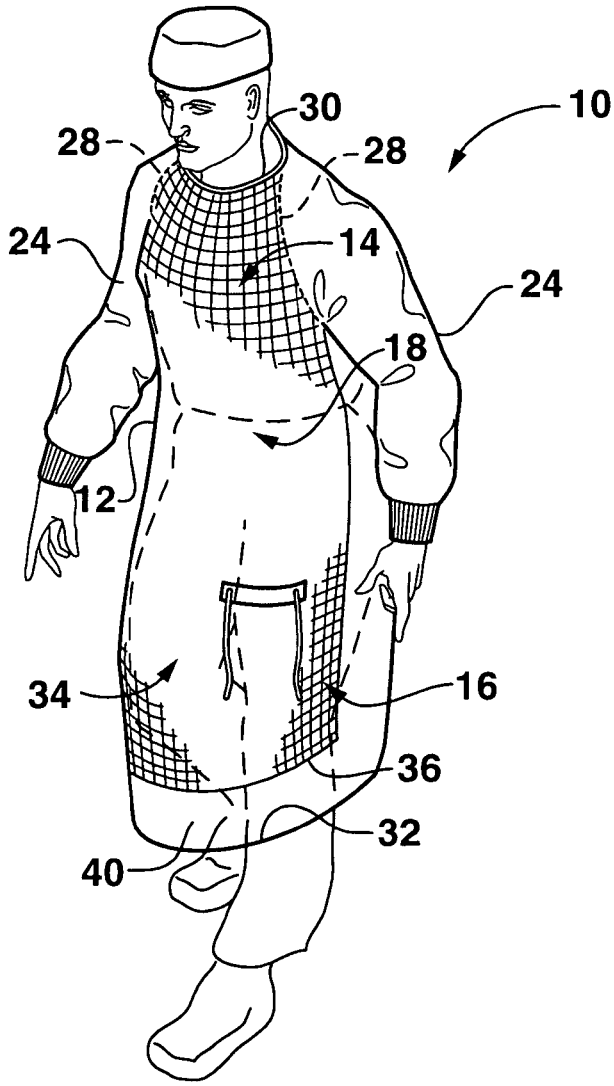
FIG. 6 is a perspective view of a garment in accordance with the present invention being worn by an individual.

The gown body 12, particularly the closed front 20, defines a neckline 30 and an opposite bottom edge 32. An upper chest region 14, a mid region 18, and a lower leg region 16 are provided between the neckline 30 and the bottom edge 32. As depicted in FIG. 6, the gown 10 has a length such that the bottom edge 32 extends below the wearer's knees.

The gown body 12 and sleeves 24 are typically made of a non-elastomeric material that is breathable yet functions as a liquid resistant barrier material. The breathability of the material increases the comfort of someone wearing such a garment, especially if the garment is worn under high heat index conditions, vigorous physical activity, or long periods of time. Various suitable woven and non-woven barrier materials are known and used in the art for garments such as surgical gowns, and all such materials are within the scope of the present invention. A suitable gown material is, for example, a Spunbond-Meltblown-Spunbond laminate as described in U.S. Pat. No. 5,464,688, incorporated herein by reference for all purposes, with appropriate chemical treatments to enhance liquid repellency and static decay.

Still referring to FIG. 1, the closed front 20 incorporates a section of elastomeric material 34 that extends generally from the upper chest region 14 to the lower leg region 16 such that a bottom 36 of the elastomeric material section 34 extends below the wearer's knees when the gown 10 is donned, as depicted in FIG. 6. As seen in FIG. 1, the elastomeric material section 34 may encompass the substantial portion of the closed front 20, and have a top that generally extends to the neckline 30 and sleeve seams 28. The elastomeric material section 34 may be stretchable in one direction, as depicted by the arrow 100 in FIG. 2, or may be stretchable in the longitudinal and transverse directions, as depicted by the double arrows 100 in FIG. 1. The bottom 36 of the elastomeric material section 34 may extend generally parallel to the bottom 32 of the gown body 12, or may be non-parallel as in the embodiment of FIG. 2.

The body 12 includes a border region 40, such as a transversely extending strip as shown in FIG. 1, of generally non-elastomeric material that extends transversely across the closed front 20 between the bottom edge 32 of the body 12 and the bottom 36 of the elastomeric material. This border region of non-elastomeric material 40 may define the bottom edge 32 of the gown 10. It should be understood that the border region 40 is "non-elastomeric" as compared to the elastomeric material section 34. The region 40 may be, for example, substantially non-elastomeric, or simply less elastomeric than section 34.

When the gown 10 is donned by a wearer, the border region 40 of non-elastomeric material is disposed below the wearer's knees, as depicted in FIG. 6. In this manner, because the elastomeric material section 34 extends below the knees, the wearer can easily spread their knees when in a seated position. The border region 40 of non-elastomeric material does not readily stretch or expand as compared to the section 34 and, thus, functions as a cuff around the bottom portion of the wearer's legs (below the knees). This cuff inhibits the gown 10 from riding up on the wearer when seated, and thus preserves the sterile field while protecting the wearer's legs.

Various elastomeric materials are known in the art that may be used for the elastomeric material section 34. The elastomeric material section 34 may, for example, be composed of a single layer, multiple layers, laminates, spunbond fabrics, films, meltblown fabrics, elastic netting, microporous web, bonded carded webs or foams comprised of elastomeric or polymeric materials. Elastomeric nonwoven laminate webs may include a nonwoven material joined to one or more gatherable nonwoven webs, films, or foams. Stretch-bonded laminates (SBL) and Neck-bonded laminates (NBL) are examples of elastomeric nonwoven laminate webs. Nonwoven fabrics are any web of material which has been formed without the use of textile weaving processes which produce a structure of individual fibers which are interwoven in an identifiable repeating manner. Examples of suitable materials are Spunbond-Meltblown fabrics, Spunbond-Meltblown-Spunbond fabrics, Spunbond fabrics, or laminates of such fabrics with films, foams, or other nonwoven webs. Elastomeric materials may include cast or blown films, foams, or meltblown fabrics composed of polyethylene, polypropylene, or polyolefin copolymers, as well as combinations thereof. The elastomeric materials may include polyether block amides such as PEBAX® elastomer (available from AtoChem located in Philadelphia, Pa.), thermoplastic polyurethanes (e.g., both aliphatic-polyether and aliphatic-polyester types), HYTREL® elastomeric copolyester (available from E. I. DuPont de Nemours located in Wilmington, Del.), KRATON® elastomer (available from Shell Chemical Company located in Houston, Tex.), or strands of LYCRA® elastomer (available from E. I. DuPont de Nemous located in Wilmington, Del.), or the like, as well as combinations thereof. The section 34 may include materials that have elastomeric properties through a mechanical process, printing process, heating process, or chemical treatment. For examples such materials may be apertured, creped, neck-stretched, heat activated, embossed, and micro-strained; and may be in the form of films, webs, and laminates.

In one particular embodiment, the elastomeric material section 34 is a neck-bonded laminate of a necked non-woven web of spunbond polypropylene laminated to an elastic film, for example a 6.8 gsm PEBAX film with 16% (by weight) of pigment grade titanium dioxide particles.

The elastomeric material section 34 is not limited to any particular shape. For example, in the embodiment of FIG. 2, the section 34 does not extend to the neckline 30 or sleeve seams 28, and has sides 35 spaced laterally inward from the side seams of the body 12. With this embodiment, the section 34 would be incorporated into the closed front 20 with a continuous seam around the periphery thereof.

Figure 3:
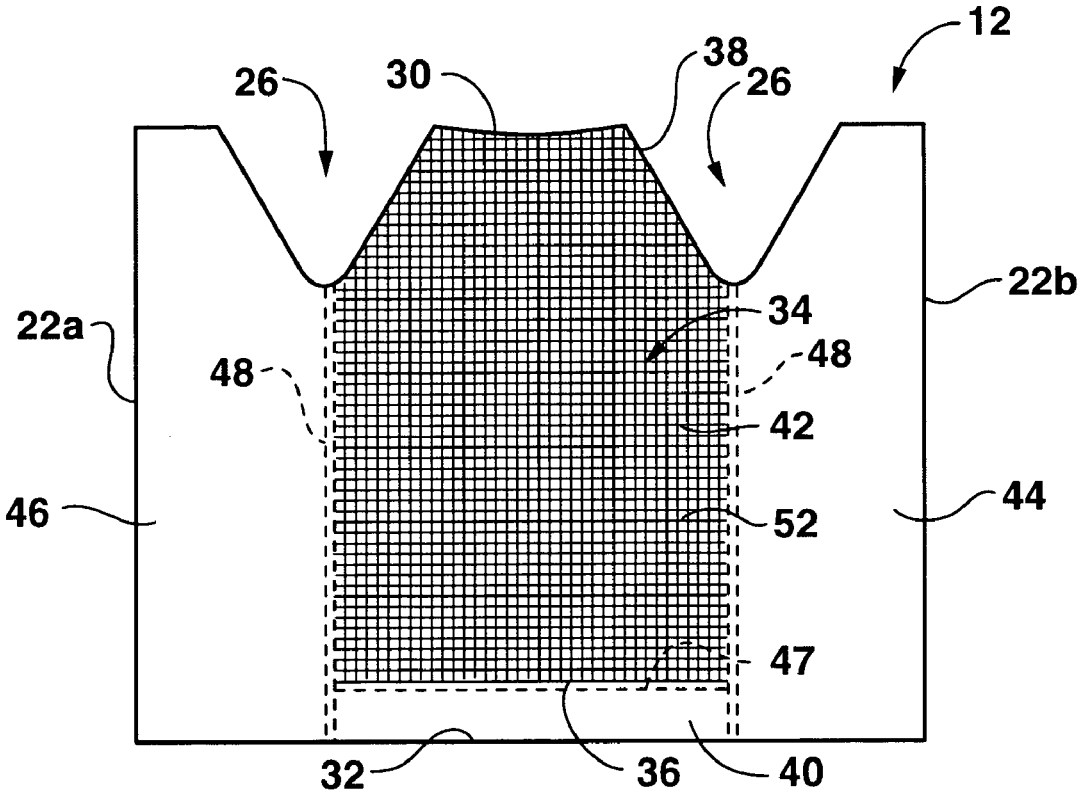
FIG. 3 is a front view of a body panel portions or a garment in accordance with the invention.

In a particular embodiment as illustrated for example in FIG. 3, the gown body 12 is assembled from separately formed panels. The open back is defined by opposite back panels 44, 46 attached to a front panel 42 along longitudinal side seams 48. The panels 42, 44, and 46 have cut-outs defining sleeve openings 26. Separately formed sleeves may be attached to openings 26, as is known in the art. The front panel 42 may be defined substantially from the elastomeric material section 34 with the bottom border 40 of non-elastomeric material being provided by a separate piece of material that is attached along the bottom 36 of the section 34, the border 40 also defining the bottom edge 32 of the body 12.

Figure 4:
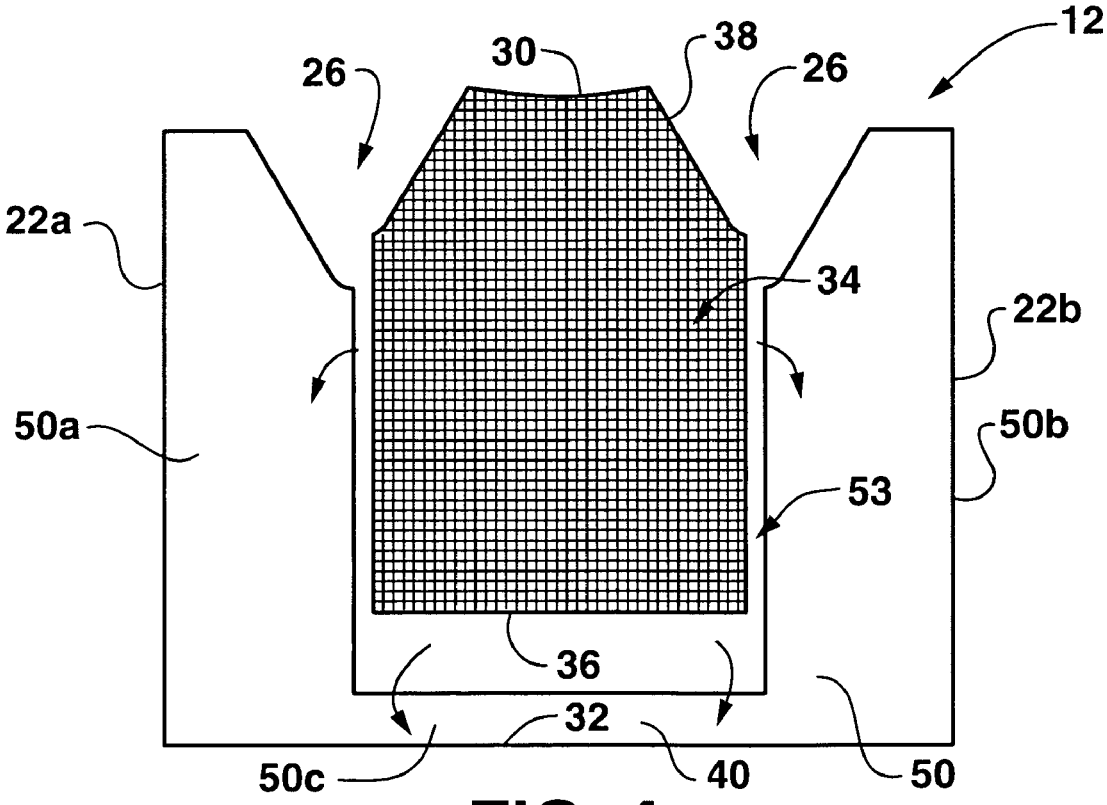
FIG. 4 is a front view of an alternate panel construction for a garment in accordance with the invention.

In still an alternate embodiment as depicted in FIG. 4, the gown body 12 may be defined by a single integral panel 50 of generally non-elastomeric material. The panel includes sections 50*a* and 50*b* that define the open back 22, and a section 50*c* defining at least a portion of the closed front 20. The elastomeric material section 34 is provided as a bib-type insert 52 that is fitted to an opening 53 defined in the front panel section 50*c*. The opening 53 may be die cut, or otherwise defined in the panel section 50*c*, with the removed material being used for other purposes, for example to form the sleeves 24. With the embodiment of FIG. 4, the opening 53 is open-sided at the top such that the bib insert 52 defines at least a portion of the neckline 30.

Figure 5:
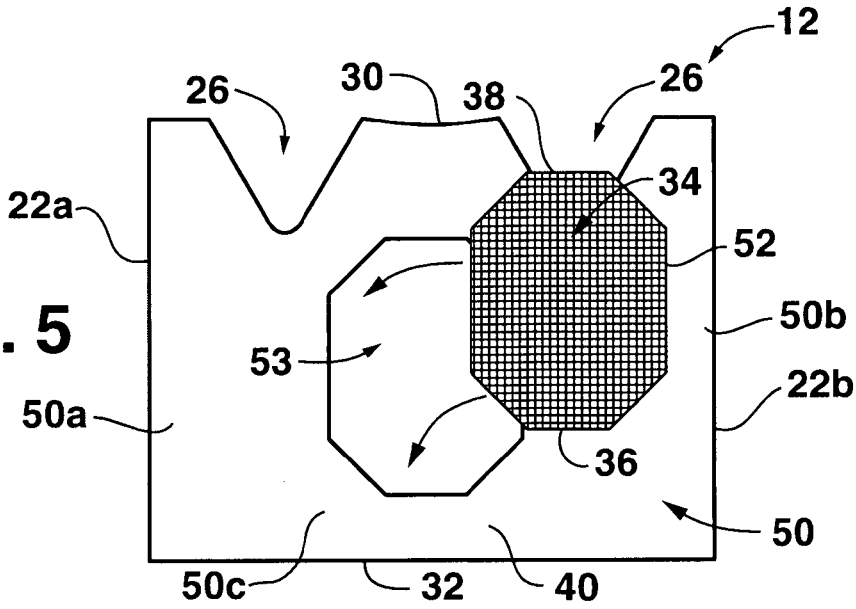
FIG. 5 is a front view of still another panel construction or a garment in accordance with the invention.

The embodiment of FIG. 5 is similar to that of FIG. 4, except that the opening 53 is closed-sided such that the bib insert 52 is completely surrounded by non-elastomeric material of the panel section 50*c*.

It should be understood that the method by which the elastomeric material section 34 is attached into the closed front 20 of the gown body 12 is not limiting. Any suitable attaching method may be used. For example, the section 34 may be sonically or ultrasonically welded to the gown material. The section 34 may be stitched, taped, or otherwise adhered to the gown material. The section 34 may be thermally bonded to the gown material. Any one of a number of known conventional attaching methods may be used for this purpose.

It should be appreciated by those skilled in the art that the system and method according to the invention have wide applications, and that the example and embodiments set forth herein are merely exemplary. It is intended that the present invention include such uses and embodiments as come within the scope and spirit of the appended claims.

What is claimed is:

1. A protective garment, said garment comprising:

a body having a closed front, an open back, and sleeves, said closed front defining a neckline and a bottom edge that extends below a wearer's knees when said garment is donned;

said closed front incorporating a section of elastomeric material that extends generally from an upper chest region of said garment to a location above said bottom edge of said garment that is also below a wearer's knees when said garment is donned; and a border region of non-elastomeric material extending generally transversely across said closed front between said bottom edge of said garment and a bottom of said elastomeric material.

2. The protective garment as in claim 1, wherein said elastomeric material section extends to said neckline.

3. The protective garment as in claim 1, wherein said elastomeric material section extends transversely across said chest region between said sleeves.

4. The protective garment as in claim 1, wherein said bottom of said elastomeric material section extends generally parallel to said bottom edge of said garment along at least a portion thereof.

5. The protective garment as in claim 1, wherein said elastomeric material section is stretchable in a transverse direction across said closed front.

6. The protective garment as in claim 5, wherein said elastomeric material section is also stretchable in a longitudinal direction.

7. The protective garment as in claim 1, wherein said closed front is formed from a first panel, and said open back is formed by second and third opposite panels of non-elastomeric material attached to longitudinally extending sides of said first panel.

8. The protective garment as in claim 7, wherein said border region of non-elastomeric material is attached to said bottom of said elastomeric material section and to said second and third back panels.

9. The protective garment as in claim 1, wherein said open back and said border region of non-elastomeric material are formed of a single piece of non-elastomeric material, and said elastomeric material section comprises a bib insert attached to said single piece of non-elastomeric material to define said closed front.

10. The protective garment as in claim 1, wherein said garment is a surgical gown.

11. A surgical gown, said gown comprising:

a body panel defining a closed front portion, and an open back defined by back portions, said back portions made from a first generally non-elastomeric material, said closed front portion and said back portions defining sleeve openings;

separately formed sleeves attached to said sleeve openings along a sleeve seam;

said closed front portion incorporating a section of elastomeric material that extends generally from an upper chest region of said gown to a location above a bottom edge of said gown that is also below a wearer's knees when said gown is donned; and a border region of non-elastomeric material extending generally transversely across said closed front between said bottom edge of said gown and a bottom of said elastomeric material section.

12. The surgical gown as in claim 11, wherein said back portions are formed separately from and attached to said closed front portion along longitudinal side seams, said elastomeric material section extending between said side seams.

13. The surgical gown as in claim 11, wherein said elastomeric material section extends to a neckline of said closed front portion.

14. The surgical gown as in claim 11, wherein said back portions and said border region of elastomeric material are formed from an integral sheet of material, said elastomeric material section comprising a bib insert member attached to said border region of elastomeric material and said back portions.

* * * * *